US006276757B1

(12) United States Patent
Brown

(10) Patent No.: US 6,276,757 B1
(45) Date of Patent: Aug. 21, 2001

(54) BACK SUPPORT IMPROVEMENT

(75) Inventor: Justin Peter Brown, Kensington Park (AU)

(73) Assignee: Klasse Pty Ltd. (AU)

( * ) Notice: Subject to any disclaimer, the term of this patent is extended or adjusted under 35 U.S.C. 154(b) by 0 days.

(21) Appl. No.: 09/442,838

(22) Filed: Nov. 18, 1999

(30) Foreign Application Priority Data

Nov. 23, 1998 (AU) ..... PP7254

(51) Int. Cl.[7] ..... B60N 2/22
(52) U.S. Cl. ..... 297/353; 297/411.36
(58) Field of Search ..... 297/353, 411.36

(56) References Cited

U.S. PATENT DOCUMENTS 4,384,742 * 5/1983 Wisneiwski ..... 297/353
4,639,039 * 1/1987 Donovan ..... 297/353
4,660,885 * 4/1987 Surh et al. ..... 297/353
4,749,230 * 6/1988 Tornero ..... 297/353
5,324,096 * 6/1994 Schultz ..... 297/353 X
5,586,809 * 12/1996 Szmadzinski ..... 297/353
5,649,741 * 7/1997 Beggs ..... 297/353
5,664,842 * 9/1997 Tseng ..... 297/353
5,685,609 * 11/1997 Miotto ..... 297/353
5,695,249 * 12/1997 Lotfi ..... 297/353
5,725,278 * 3/1998 Verbeek ..... 297/353
5,735,577 * 4/1998 Lin ..... 297/353 X
5,765,920 * 6/1998 Lai ..... 297/411.36

* cited by examiner

*Primary Examiner*—Peter M. Cuomo
*Assistant Examiner*—Rodney B. White
(74) *Attorney, Agent, or Firm*—Akerman Senterfitt

(57) ABSTRACT

A chair back support arrangement of a type including an upright supporting a back support arranged to slidably engage the upright, and interlocking means to maintain a selected support height for the back support, the interlocking means including a rack either affixed to or being part of the upright an engaging member supported by the back support and arranged to selectively interlock with the rack and being able to be activated to effect a change from interlocking to not interlocking by a change by relative positioning of the back support with respect to the upright. A catch is supported by the support back so that in one position, it can catch and hold in a non-engaging position, the engaging member clear of the rack, and in another position, it will release such engaging member to effect an interengaging action with the rack.

4 Claims, 6 Drawing Sheets

BACK SUPPORT IMPROVEMENT

This invention relates to a back support and, in particular, to a back support for a chair which is able to be of adjustable height with respect to an upright supported by the chair.

BACKGROUND OF THE INVENTION

An object of this invention is to propose a chair back support improvement which is at least different from those that have hitherto been provided and therefore provides a useful alternative for those wishing to purchase such units.

BRIEF SUMMARY OF THE INVENTION

In one form of this invention there is proposed a chair back support arrangement including an upright to be supported by a chair base and a back support adapted to slidably engage the upright, and interlocking means to maintain a selected support height for the back support, the interlocking means including a rack either affixed to or being part of the upright, an engaging member supported by the back support and arranged to assume either of two positions, one of which is to interlock with the rack, and the other of which is to be clear of the rack, and means to change the position of the engaging member from one of said positions to the other which means are able to be activated to effect such change by relative positioning of the back support with respect to the upright.

The purpose is to provide for an adjustable support for the back relative to the upright where the adjustment can be achieved without necessarily having an external lever or button so that it is the relative position of the two parts that will effect control of the engaging member and enable an adjustment of the height of the back support appropriately thereby.

In preference, there is a catch supported by the support back the position of which can be caused to change by relative positioning of the back support with respect to the upright so that in one position, it can catch and hold in a non-engaging position, the engaging member clear of the rack, and in another position, it will release such engaging member to effect an interengaging action with the rack.

In preference, the catch is a member pivotally supported by the back support and arranged so that when the back support is moved to a first end position, there is an interengaging between the catch and the upright whereby to effect an opening of the catch position to allow the engaging member to be released to resume an interengaging or interlocking position with respect to the rack.

In preference, in respect of a further end position of the back support with respect to the upright, the engaging member is caused by reason of an interengaging of a portion of the upright with respect to the engaging member, to be pushed into a position in which it is clear of an interengaging or interlocking position with respect to the teeth but also is further located so as to interlock with the catch member.

In preference, the catch member is urged toward a catching position by reason of a resilient member extending between the catch member and the back support.

In preference, the engaging member has interengaging teeth which are adapted to interengage with the teeth on the upright and which are respectively shaped so that the engaging member will allow for relative movement of the engaging member and therefore the back support to which it is attached, with respect to the upright in one direction but not the other.

By having the respective teeth having an inclined bias, such that when the engaging member with its teeth interengaging with the teeth of the rack are pulled in one direction, there will be a relative sliding effect urging the teeth out of an engaging position but holding tight against the edge of the rack to the next tooth.

There is therefore in effect a ratchet like arrangement which allows for the back support and of course any back supported by the back support to move under this ratchet effect in one direction even when the engaging member is in an engaging or interlocking position.

To enable a reverse relative positioning however, it would then be necessary to proceed to an end position in which the engaging member is pushed out further to a stage where it will be captured by the capture member and held in a fully clear of interlocking relationship with the rack then until the back support is moved to the further end position where there is a release shape on the capture member which will push the capture member into a further position releasing the engaging member.

BRIEF DESCRIPTION OF THE DRAWINGS

The invention will be better understood when described with relation to a preferred embodiment which will now be described with the assistance of drawings which are a side view of the arrangement in a working position and snowing the respective relative positions of the back support relative to The upright of a chair, accordingly.

DETAILED DESCRIPTION

Figure 1:
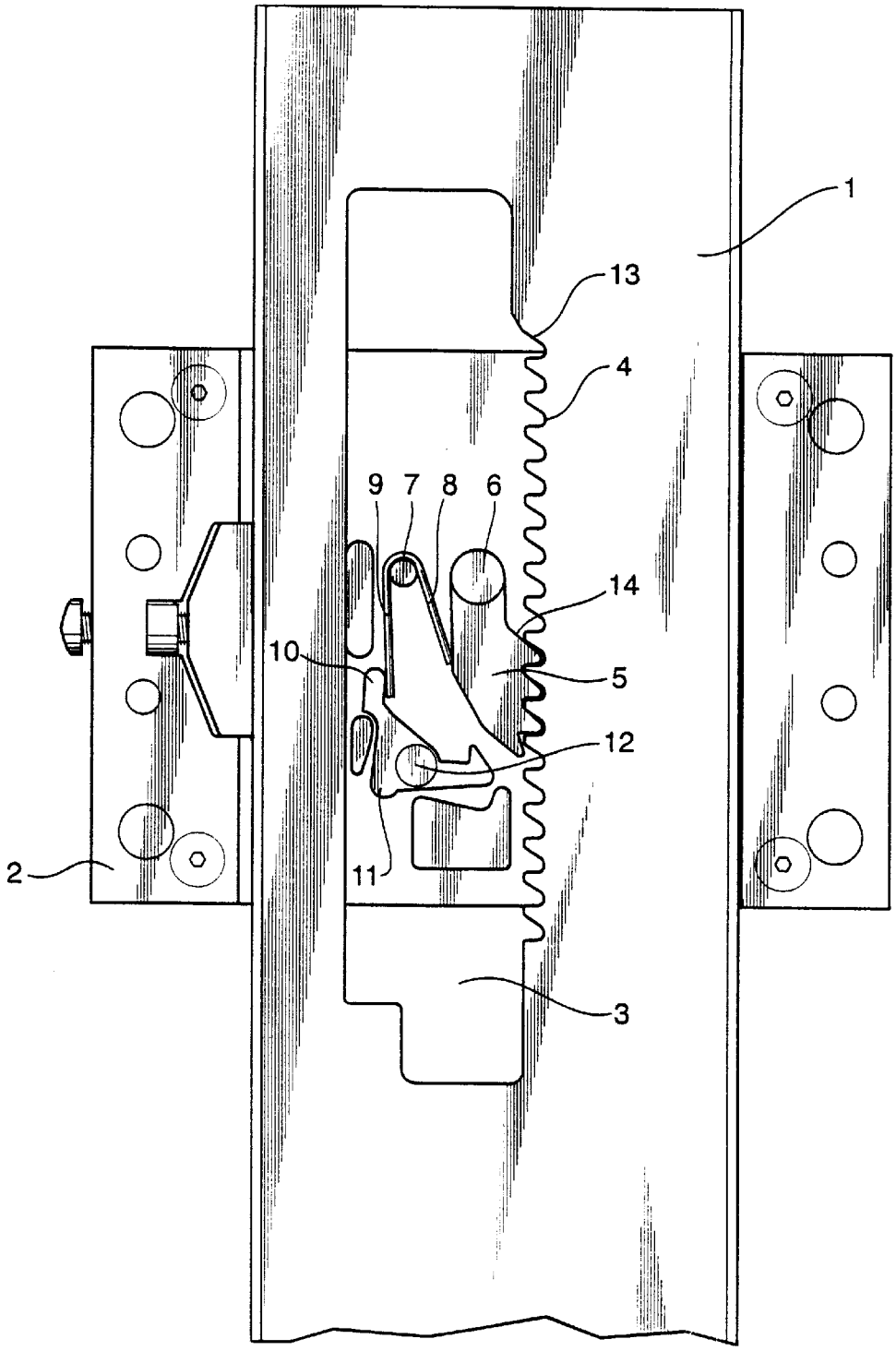
FIG. 1 shows the back support in an approximately central position with an engaging member in a ratcheting position interlocking with the rack of the upright.

Referring to the drawings in detail, there is an upright 1 which is intended to be supported at the lowermost end by a chair or chair base and provide for slideable support of a back support 2 which a back would be affixed.

The invention has for its purpose the provision of an arrangement where it is not necessary to have external buttons or other levers or controls to allow for adjustment of the back relative to the upright.

There is accordingly provided a recess 3 within the upright 1 which includes extending in the direction of elongation direction of the upright 1, a rack of teeth 4 the shape of which is such as to provide for a ratchet interengagemertt with respect to an interengaging member 5.

The interengaging member 5 is pivotally supported at 6 to the back support 2.

Further, there is a resilient U-shaped spring 7 one leg of which at 8 engages against a back of the engaging member 5 and the other leg of which at 9 engages against an upper portion 10 of a capture member 11.

The capture member 11 is pivotally supported at 12 to the back support 2.

Figure 2:
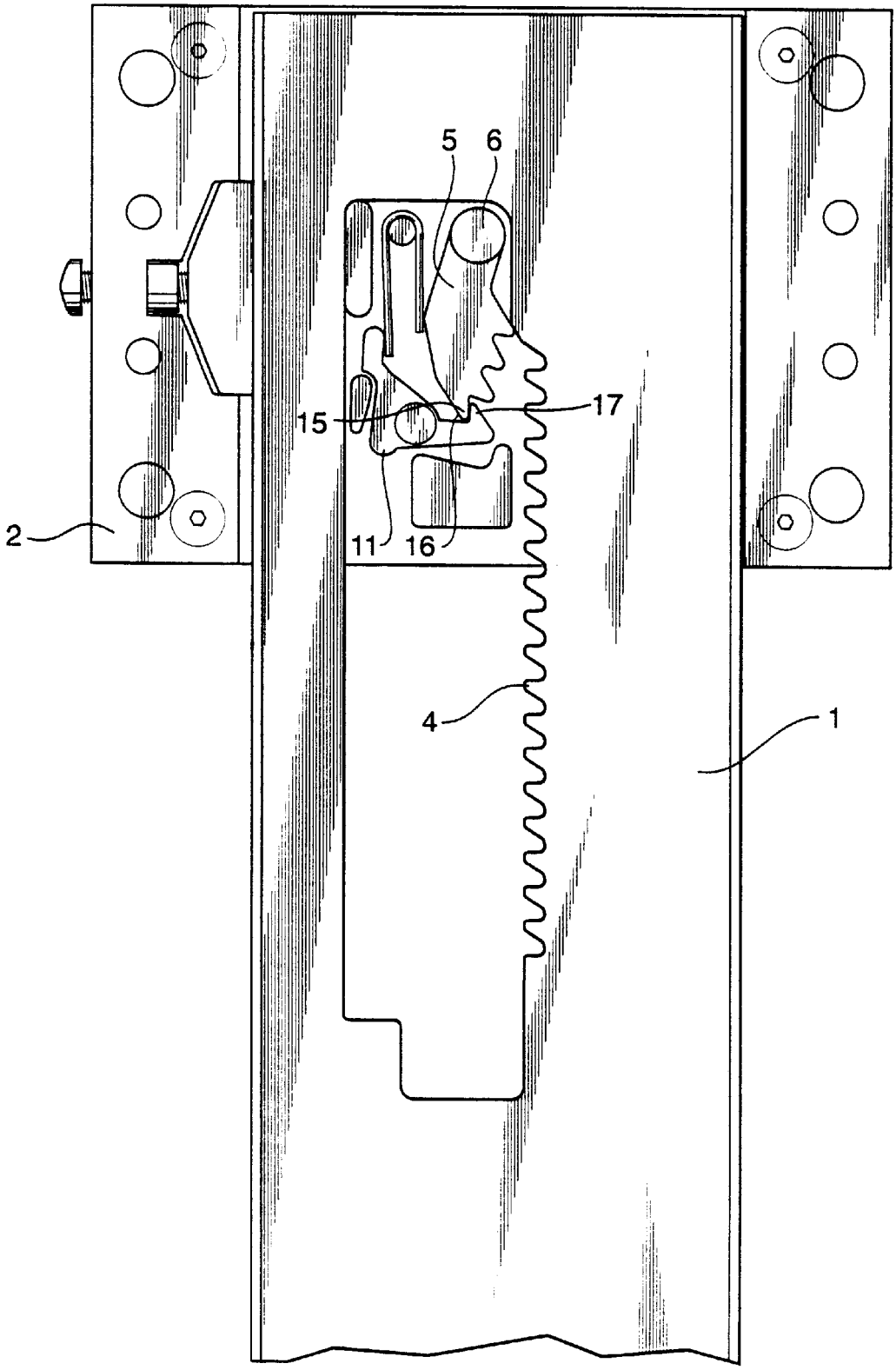
FIG. 2 is a result of the back support being further raised to the stage where the engaging member is now forced outwardly to have a lower finger interlocking with the capture finger.

At a first end of the rack of teeth 4 is an inclined face 13 which is adapted to slidably engage the inclined face 14 on the engaging member when the back support 2 is moved to the upper end position.

Where this occurs, as is shown in FIG. 2, The engaging member 5 is caused to rotate about its pivot support 6 to a stage where a lowermost part at 15 which has on a back side an inclined plane at 16 which therefore rides against the front edge of the similarly inclined outer edge of finger 17 of the capture member 11 to be there by caught.

From here on, the engaging member is therefore kept clear from an interengaging or interlocking relationship with the rack of teeth 4 and the back support 2 is therefore free to be moved in any relative position.

However, with a back attached to the back support, and with the back support in this situation being at its highest position, there would be a natural gravitational force to urge the back support downwardly to a further end position which is to say where the back support 2 is at its lowest position relative to the upright 1.

Figure 3:
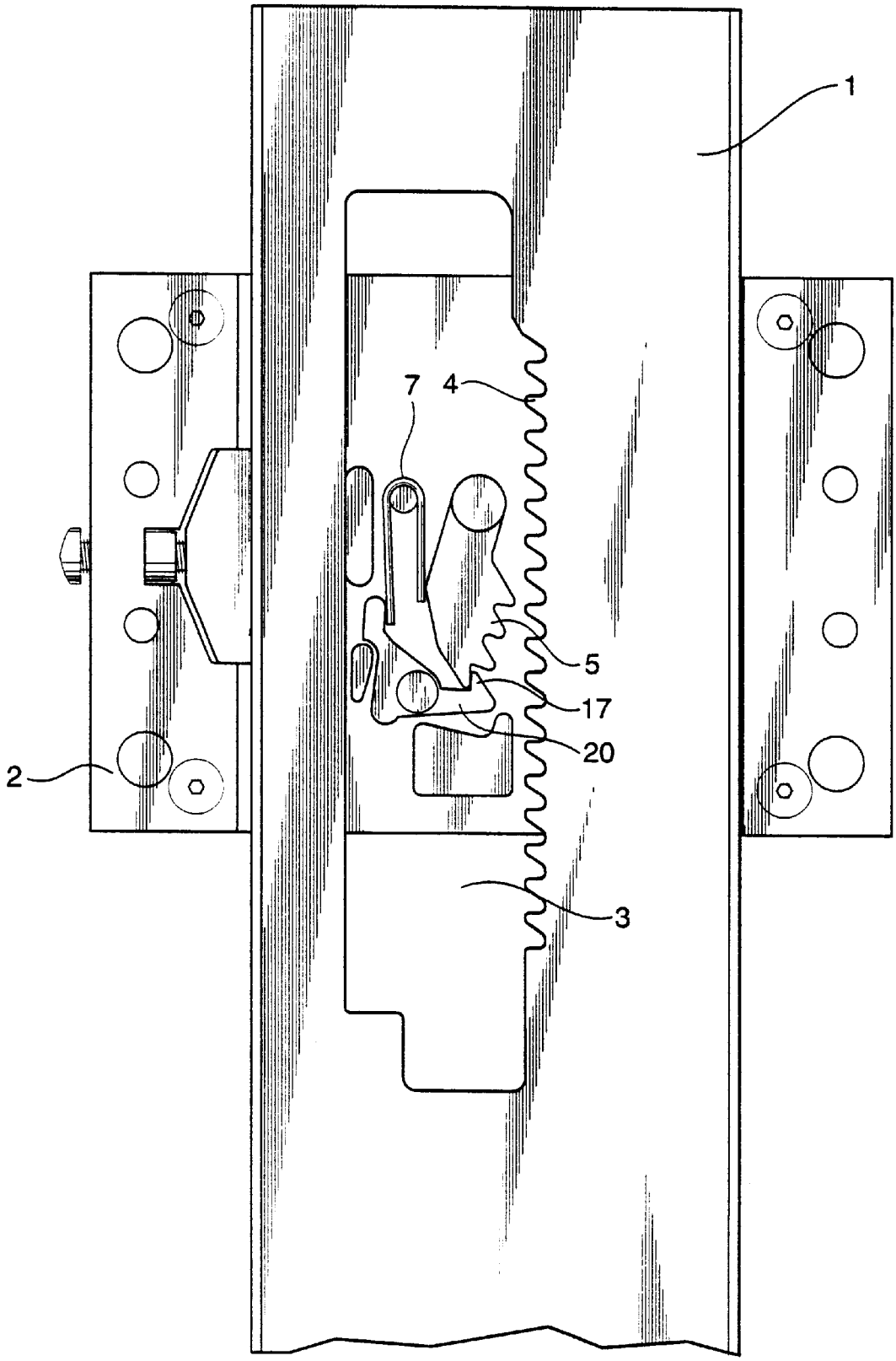
FIG. 3 shows the back support now being lowered while the engaging member is held clear of interlocking with the rack by the capture member.

A mid position is shown in FIG. 3 in which the engaging member 5 is still held from an engaging position in respect to the rack of teeth 4.

Figure 4:
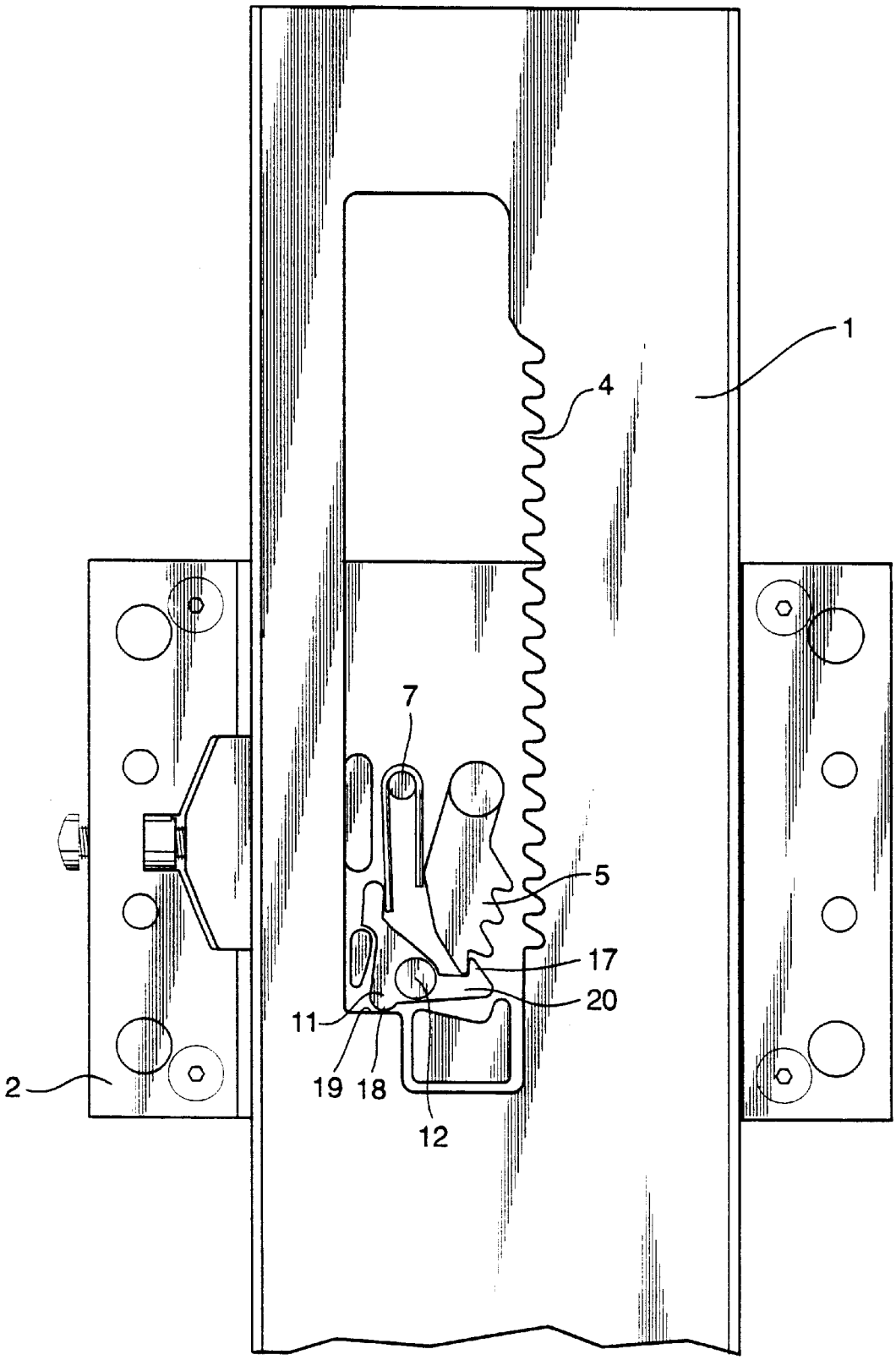
FIG. 4 shows the back support in the position where the capture member is being caused to moved from a capturing position by interengaging with a portion of the upright.

When the back support is in its lowermost end position as shown in FIG. 4, there is a lowermost part 18 of the capture member 11 which will come against the abutting part 19 at the lower end of the recess of the upright 1.

With slightly further downward pressure, this will then cause the capture member 11 to rotate slightly clockwise about its pivot 12 which is generally being resisted by pressure from the U-shaped spring 7 but however this will have the result of lowering a tongue 20 which will release the engaging member 5.

Figure 5:
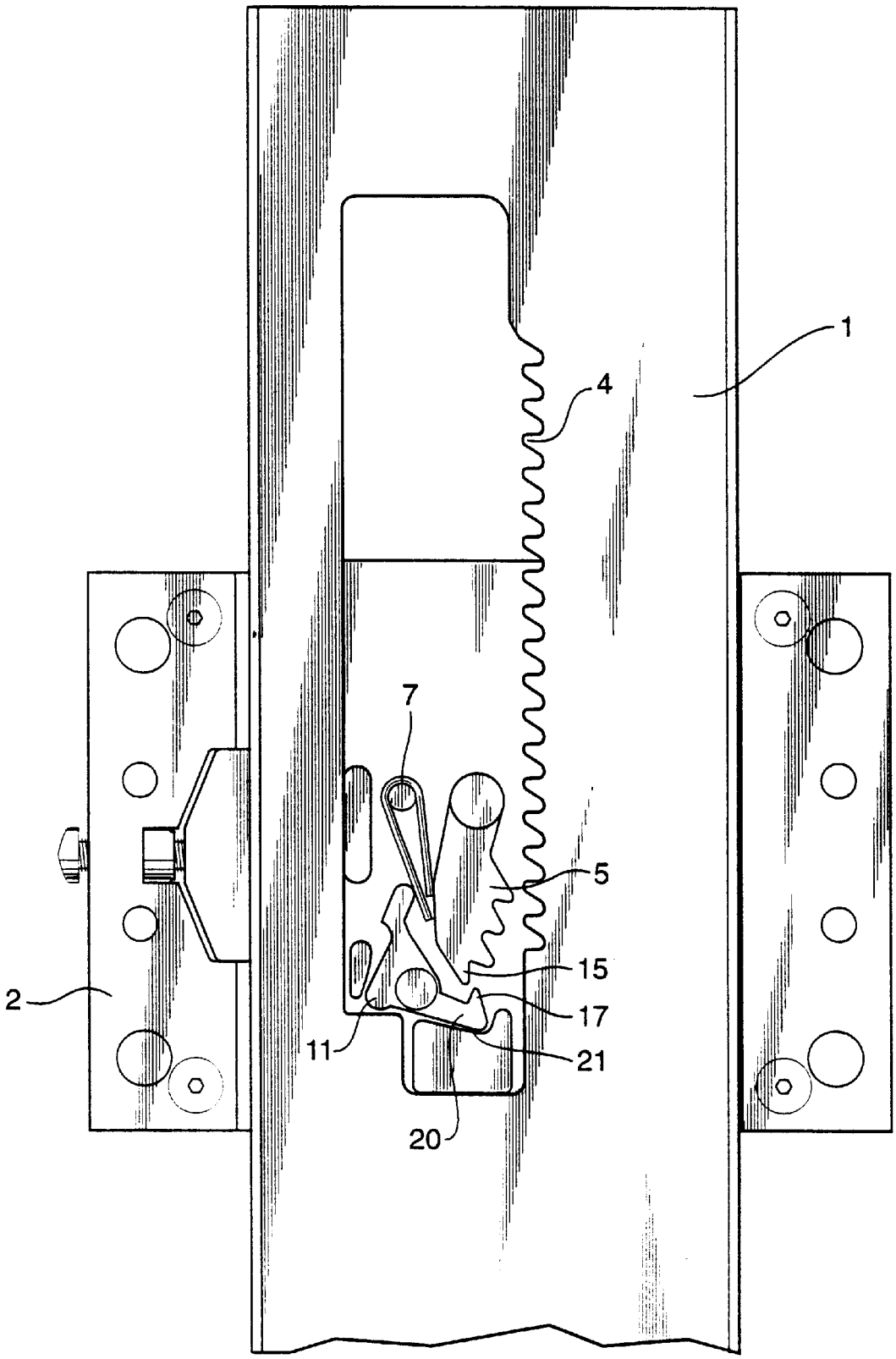
FIG. 5 shows the result of this being further progressed where the engaging member is now released and is therefore subject to pressure from a resilient member.

This then leaves the position as shown in FIG. 5 in which the capture member 11 is now fully rotated and is nesting within an abutting portion of the back support at 21 but nonetheless is such that the finger 17 will now be clear of the part 15 of the engaging member 5 which is then free under the influence of the spring 7 to return to the first position which is an interlocking or interengaging position of its teeth with those of the rack of teeth 4.

Figure 6:
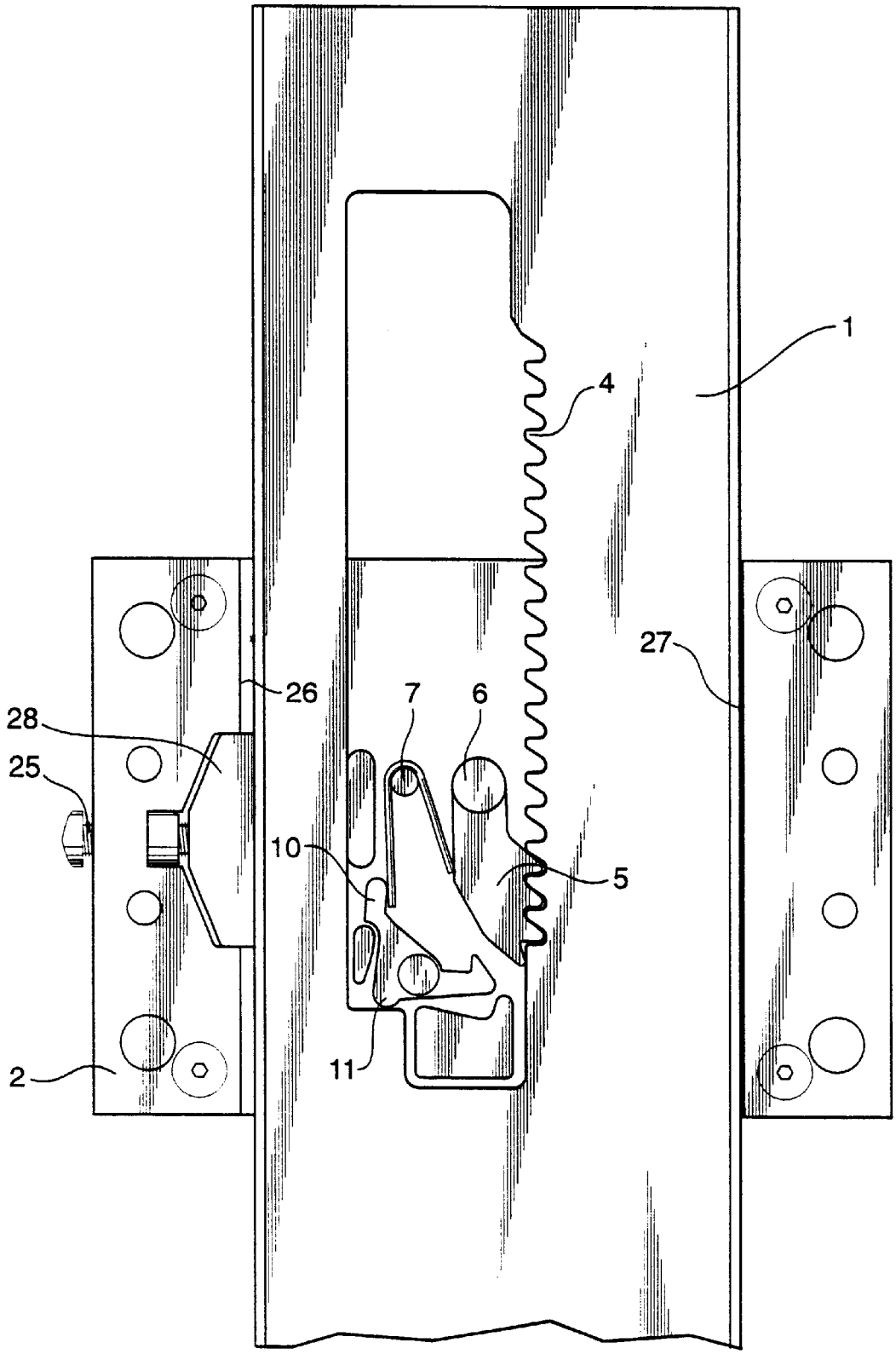
FIG. 6 is the result immediately subsequent to the position in FIG. 5 where the engaging member then takes up an engaging position with the rack.

As a final step then as shown in FIG. 6, the interengaging member 5 resumes an interlocking position which is the first of the positions that this can assume by rotation about its pivot support at 6 and the capture member 11 is returned to a storage position by pressure of the spring 7 part 10.

The back support member 2 has an adjustment at 25 which allows for adjustment of the relative clearance between engaging inner edges at 26 and 27 by reason of slide 28.

It is known that while this is the preferred embodiment, changes can be made which will not depart from the spirit of the invention.

While the engaging member is held under a spring pressure, it would also be possible to have this assume its position by other means including allowing it to be biased by its own weight.

Likewise, the capture member could be caused to assume a first interlocking position again by appropriate arrangement of the relative balance of its weight about its pivot support. The use of a spring can be of assistance but one of the features of the arrangement described is that it could be achieved without the additional use of the spring.

The use of a separate capture member which is itself pivotally supported with respect to the back support allows for accurate alignment of the respective faces which will necessarily interengage and cause a locking or interlocking effect.

Further, the arrangement described is suitable for mass manufacture both economically and effectively and will provide for a product that will be of long lasting character and which can, as described, allow for adjustment without the necessity of any external lever or button or other control.

What is claimed is:

1. A chair back support arrangement, comprising:

an upright supported by a chair base;

a back support adapted to slidably engage the upright;

interlocking means to maintain a selected support height for the back support with respect to the upright, wherein the interlocking means includes a rack forming part of the upright;

an engaging member supported by the back support and arranged to assume either of two positions, one of which is to interlock with the rack, and the other of which is to be clear of the rack;

means to change the position of the engaging member from one of said positions to the other, wherein said changing means is able to effect such change by relative positioning of the back support with respect to the upright;

a catch pivotally supported by the back support, the position of which catch can be caused to change by relative positioning of the back support with respect to the upright so that in an interlocking position, it interlocks the engaging member in a non-engaging position clear of the rack, and in a release position, it will release such engaging member to effect an interengaging action with the rack, and wherein the catch is arranged so that when the back support is moved to an end position, there is an inter engagement between the catch and the upright, thereby moving the catch from its interlocking position to its release position to allow the engaging member to be released therefrom to resume an interengaging or interlocking position with respect to the rack.

2. A chair back support arrangement as in claim 1 further comprising:

a catch supported by the back support, the position of which catch can be caused to change by relative positioning of the back support with respect to the upright so that in a catching position, it catches the engaging member in a non-engaging position clear of the rack, and in another position, it releases such engaging member to effect an interengaging action with the rack; and wherein the catch member is urged toward its catching position by a resilient member extending between the catch member and the back support.

3. A chair back support arrangement, comprising:

an upright supported at a lowermost end by a chair or chair base, wherein said chair base provides slidable support of a back support to which a back would be affixed;

a recess within the upright which includes, extending in a direction of elongation of the upright, a rack forming a part of the upright and having teeth the shape of which are such as to provide for a ratchet interengagement with respect to an engaging member, the engaging member being pivotally supported by the back support;

a resilient U-shaped spring, one leg of which engages against the engaging member and another leg of which engages against an upper portion of a capture member, the capture member being pivotally supported by the back support; and at an end of the rack, an inclined face on the upright which is adapted to slidably engage an inclined face on the engaging member when the back support is moved to an end position adjacent to the end of the rack having the inclined face.

4. A chair back support as in preceding claim 3 further characterised in that the engaging member is caused to rotate about its pivot support to an extent where a lowermost part which has, on a back side, an inclined plane, rides against a front edge of a similarly inclined outer edge of a finger of the capture member to be caught thereby.

* * * * *